US005411671A

United States Patent [19]

Bauer et al.

[11] Patent Number: 5,411,671

[45] Date of Patent: May 2, 1995

[54] FABRIC CONDITIONING COMPOSITIONS AND PROCESS FOR MAKING THEM

[75] Inventors: Herbert E. Bauer, Saddle Brook; Michael G. Clarke, Basking Ridge; John E. Lovas, Kearny; William R. Narath, Parsippany; Andrew N. Williams, Franklin Lakes, all of N.J.

[73] Assignee: Lever Brothers Company, Division of Conopco, Inc., New York, N.Y.

[21] Appl. No.: 177,505

[22] Filed: Jan. 5, 1994

Related U.S. Application Data

[63] Continuation-in-part of Ser. No. 909,359, Jul. 6, 1992, Pat. No. 5,288,417.

[51] Int. Cl.[6] ..... B01F 3/08; B01F 5/06

[52] U.S. Cl. ..... 252/8.6; 252/8.7; 252/8.8; 252/8.9

[58] Field of Search ..... 252/8.9, 8.6, 8.7, 8.8

[56] References Cited

U.S. PATENT DOCUMENTS

| | | | |
|---|---|---|---|
| 3,681,241 | 8/1972 | Rudy et al. | 252/8.8 |
| 3,933,871 | 1/1976 | Armstrong | 252/8.75 |
| 3,954,634 | 5/1976 | Monson et al. | 252/8.8 |
| 3,974,076 | 8/1976 | Wiersema et al. | 252/8.6 |
| 4,137,180 | 1/1979 | Naik et al. | 252/8.75 |
| 4,379,059 | 5/1983 | Hockey et al. | 252/8.8 |
| 4,439,335 | 3/1984 | Burns | 252/8.75 |
| 4,464,273 | 8/1984 | Parslow et al. | 252/8.8 |
| 4,654,152 | 3/1987 | Cukier et al. | 252/8.8 |
| 4,661,270 | 4/1987 | Grandmaire et al. | 252/8.75 |
| 4,789,491 | 12/1988 | Chang et al. | 252/8.75 |
| 4,844,821 | 7/1989 | Mermelstein et al. | 252/8.7 |
| 4,844,823 | 7/1989 | Jacques et al. | 252/8.8 |
| 4,976,878 | 12/1990 | Coffindaffer | 252/8.6 |
| 4,994,193 | 2/1991 | Wahl | 252/8.8 |
| 5,062,972 | 11/1991 | Baeck et al. | 252/8.8 |

FOREIGN PATENT DOCUMENTS 63-77470 10/1989 Japan .

*Primary Examiner*—Mark L. Bell
*Assistant Examiner*—M. C. Bonner
*Attorney, Agent, or Firm*—A. Kate Huffman

[57] ABSTRACT

An aqueous fabric conditioning composition comprising a homogeneous dispersion of fabric conditioning active particles having a size distribution such that the particles have a mean size of about 0.7 to 10 microns as measured by Malvern Particle Size Analyzer and preferably have 10% of the distribution with a particle size of at least 23% of the mean particle size. The composition is obtained by a continuous process for making the aqueous fabric conditioning composition.

6 Claims, No Drawings

FABRIC CONDITIONING COMPOSITIONS AND PROCESS FOR MAKING THEM

This case is a continuation-in-part of U.S. patent application Ser. No. 07/909,359 filed Jul. 6, 1992, now U.S. Pat. No. 5,288,417.

FIELD OF THE INVENTION

In a first aspect the invention relates to fabric conditioning compositions and in particular to compositions in aqueous media which contain a high proportion of fabric conditioning ingredients.

In a second aspect the invention relates to a continuous process for making fabric conditioning compositions.

BACKGROUND OF THE INVENTION

Aqueous fabric conditioning compositions known in the art contain fabric conditioning agents which are substantially water-insoluble cationic materials having two long alkyl chains. The materials are usually in the form of an aqueous dispersion or emulsion and the addition of more than about 8% cationic material to the composition is not usually possible without incurring problems of physical instability.

There are many advantages to having more concentrated fabric conditioning compositions, for example there are shipping and packaging economies and the consumer can exercise choice in the type of performance obtained in that the concentrated product can be used as is or can be diluted to a conventional concentration before use.

Due to the desirability of formulating concentrated fabric conditioning compositions the problem of physical instability has been addressed in the art.

U.S. Pat. No. 3,681,241, Rudy, issued Aug. 1, 1972, utilizes a combination of quaternary ammonium softener, saturated imidazolinium softener, unsaturated imidazolinium softener and ionizable salts to formulate concentrated softeners, but the maximum concentration achieved is only 13%.

U.S. Pat. No. 3,954,634, Monson, issued May 4, 1976 uses a special batch processing technique of homogenization at high pressure to manufacture compositions comprising up to 15% fabric conditioning active. The various solutions proposed, however, are not entirely satisfactory in that they either require the use of substantial quantities of materials other than the fabric softener in order to reduce the viscosity or in that special processing techniques are necessary to cope with the high viscosities generated which are not practical on a commercial scale or at concentrations above about 15% cationic conditioning agent.

The high viscosities generated during the manufacture of concentrated fabric conditioning compositions limit the quantity of composition that can be made using conventional batch processing equipment due to the large amounts of energy requirement for shearing the gel phases formed. This tends to mean that batch equipment is operated below capacity and with long cycle times. This leads to low throughputs which are not commercially attractive.

U.S. Pat. No. 4,439,335, Burns, issued Mar. 27, 1984 describes such a process. A mixture of cationic conditioning salts and an inorganic ionizable salt are used to make a concentrated aqueous composition. The composition is made in a batch process by adding a portion of ionizable salt to water concurrently with a molten mixture of the actives at a rate necessary to keep the aqueous mix fluid and stirrable. In one example, 200 lbs of product are made in a 60 gallon capacity main mix tank over a period of about 25 minutes.

There thus exists a need for a process for making a concentrated aqueous liquid fabric conditioning composition by a process which is practical on a commercial scale. There is also a need for a concentrated aqueous liquid fabric conditioning composition based on cationic conditioning agents which is physically stable and of acceptable viscosity.

Japanese Patent Application No. 63-77479 Yamamura/Kao, published Oct. 4, 1989 relates to a method of manufacturing a conditioning finishing agent in a line mixer by mixing water into a supply of molten quaternary ammonium salt. The agent is made by a single addition of water and the rate of production of the softening, finishing agent is only about 3 to 4 gallons per minute.

We have now found that it is possible to make an aqueous fabric conditioning composition of acceptable viscosity and stability by a continuous process that is practical on a commercial scale.

SUMMARY OF THE INVENTION

The invention relates to an aqueous fabric conditioning composition comprising a homogeneous dispersion of fabric conditioning active particles having a size distribution such that the particles have a mean size of about 0.7 to 10 microns as measured by Malvern Particle Size Analyzer and preferably have 10% of the distribution with a particle size of at least 23% of the mean particle size, more preferably at least 29% of the mean particle size.

In a second aspect the invention relates to a continuous process for making an aqueous fabric conditioning composition comprising the steps of:

(i) selecting a fabric conditioning active, (ii) adding the active to a continuous mixer, (iii) dispersing the fabric conditioning active in water under controlled shear in the continuous mixer to form a homogeneous dispersion of the active, and (iv) mixing the dispersion with portions of electrolyte under controlled shear in the continuous mixer to maintain the homogeneous dispersion.

DETAILED DESCRIPTION OF THE PREFERRED EMBODIMENTS.

In accordance with the present invention, it has been found that it is possible to make highly concentrated aqueous fabric conditioning compositions of acceptable viscosity and stability by a continuous process that is practical on a commercial scale. Specifically a first aspect of the present invention is directed to a concentrated fabric conditioning composition comprising a homogeneous dispersion of from about 8% to about 80% of cationic conditioning active particles having a size distribution such that the mean particle size is from 0.7 to 10 microns and 10% of the distribution has a particle size of at least 29% of the mean particle size as measured by Malvern Particle Size Analyzer.

Specifically, a second aspect of the present invention is directed to a continuous process for making an aqueous fabric conditioning composition comprising from 8% to 80% of a cationic fabric conditioning agent and from 0.01% to 0.5% of an ionizable salt said process comprising the steps of:

(i) selecting a cationic fabric conditioning active, (ii) adding the active to a continuous mixer, (iii) dispersing the active in water under controlled shear in the continuous mixer to form a homogeneous dispersion of the active, (iv) mixing the dispersion with discrete portions of ionizable salt under controlled shear in the continuous mixer to maintain the homogeneous dispersion.

In the context of the present invention, by "mean particle size" is meant the size which 50% of the distribution is under or D(v,0.5) in Malvern terminology. By "particle size of 10% of the distribution" is meant the size which 10% of the distribution is under or D(v,0.1) in Malvern terminology.

The compositions of the invention are stable and pourable at normally encountered temperatures (40° F.–105° F.) and are easily dispersible in water. In the context of the present invention "stable and pourable" means having a viscosity below about 1000 centipoises (cp or cps) following 2 weeks storage at 105° F. as measured by Brookfield Viscometer on Spindle No 1 at 12 rpm and about 80° F. or Spindle No. 3 at 30 rpm and about 80° F. as known in the art. Preferably the compositions have a viscosity below about 800cP following two weeks storage at 105° F. and more preferably below 800cP following four weeks storage at 105° F.

We have found that the compositions of the invention have a homogeneous dispersion of conditioning active particles. In the context of the present invention, homogeneous dispersion means a dispersion that is uniform and without pockets of flocculated active material. Compositions with a homogeneous dispersion of particles having a size distribution with a mean size in the range according to the invention have been found to be particularly stable.

Preferably, the composition comprises from 8% to 80% by weight of a cationic fabric conditioning material, more preferably 15% to 70% and even more preferably 20% to 50% by weight.

Cationic fabric conditioning materials suitable for use in the present invention are insoluble types of general formula:

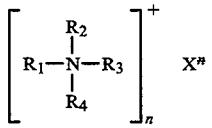

(I)

wherein $R_1$ and $R_2$ are each hydrocarbyl groups containing from about 1 to about 25 carbon atoms, $R_3$ and $R_4$ are each hydrocarbyl groups containing from 1 to about 6 carbon atoms. X is an anion and n is an integer from 1 to about 3. The term hydrocarbyl as used herein encompasses alkyl, alkenyl, aryl, alkaryl, substituted alkyl and alkenyl, ester linked alkyl and alkenyl, and substituted aryl and alkaryl groups. Common substituents found on quaternary compounds include hydroxy and alkoxy groups.

Preferred cationic fabric conditioning agents are:

(i) difatty alkyl amidoammonium salts of formula:

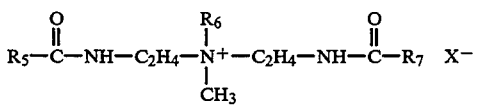

(II)

wherein $R_5$ and $R_7$ are the same as each other or different and are selected from the group consisting of $C_{14}$ to $C_{22}$ alkyl or alkenyl groups, and $R_6$ is selected from the group consisting of methyl or $(C_nH_{2n}O)\times H$ wherein n is 2 or 3 and X is from 1 to 5, and wherein X' is an anion, preferably selected from the group consisting of halides, sulphates, acetates or alkyl sulphates having from 1 to 3 carbon atoms in the alkyl chain. It is particularly preferred that the difattyalkyl amidoammonium salt should have a particularly low level of residual ethoxylated amine, specifically less than about 12% of the difattyalkyl amidoammonium salt. Preferred agents include the Accosoft series supplied by Stepan.

(ii) ester-linked trialkyl ammonium salts of formula:

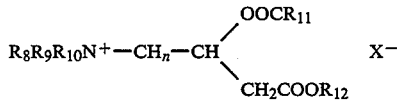

(III)

wherein $R_8$, $R_9$ and $R_{10}$ are each an alkyl or hydroxyalkyl group containing from 1 to 4 carbon atoms or a benzyl group; $R_{11}$ and $R_{12}$ are each an alkyl or alkenyl chain containing from 11 to 23 carbon atoms and $X^-$ is an anion as defined above. Such ester linked compounds are more fully described in U.S. Pat. No. 4,137,180, Naik, herein incorporated by reference.

(iii) imidazolinium salts of formula;

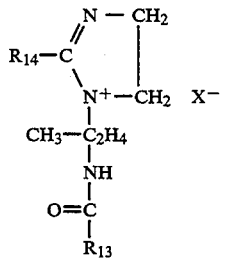

(IV)

wherein $R_{12}$ and $R_{13}$ are the same or different and are selected from the group consisting of $C_{14}$ to $C_{22}$ alkyl or alkenyl groups, and wherein $X^-$ is an anion. Preferred compounds are those where $R_{12}$ and $R_{13}$ are hydrogenated tallow.

Particularly preferred compositions comprise from about 20% to about 35% of a difatty alkyl amidoammonium salt of formula II above and from 2% to about 10% of a second cationic conditioning of formulas I, III and IV or mixtures thereof.

Preferably the composition comprises from 0.01% to 0.5% of an inorganic water-soluble ionizable salt, more preferably 0.10 to 0.3%. Examples of suitable salts are the halides of the group 1A and 2A metals of the Periodic Table of Elements e.g., sodium chloride, potassium bromide, lithium chloride, calcium chloride and magnesium chloride.

Various optional materials such as are ordinarily used in fabric conditioning compositions can be used in the compositions herein. These include, for example, perfumes at 0.05% to 1.5%, antimicrobials at 0.01% to 0.2% and dyes at 0.001% to 0.01%.

The process of the invention enables concentrated compositions to be made on a commercial scale. The continuous process avoids the need to mix large quantities of highly viscous gels as would be encountered in a batch process and has the advantage that less energy is consumed than in an equivalent batch process.

The continuous mixer comprises a 4 inch diameter pipeline equipped with a series of in-line mixers. Addition of the components of the composition is achieved via ports located immediately upstream of a mixer at various points along the pipeline. Dynamic mixers are used to mix the active and water and may be of Gifford-Wood type equipped with a turbine capable of peripheral velocities of from 0 to 100 feet per second. Alternative dynamic mixers to the Gifford-Wood type are Ika, Ross and Dicon.

A preferred embodiment of the process is as follows. The cationic fabric conditioning agent is heated until molten and mixed in an in-line dynamic mixer with a premix of deionized water, preservative and dye to form a homogeneous dispersion of the active in water. A solution of calcium chloride in water (2.5–10%) is dosed and mixed under controlled shear into the dispersion in a series of distinct sequential additions. The stream of fabric conditioning composition is then cooled in-line and again dosed with calcium chloride. Optionally further cooling takes place by collecting the product in an agitator vessel and recirculating the product through a heat exchanger. Calcium chloride is dosed again to adjust the viscosity and perfume is added and mixed in a relay tank.

Preferably the calcium chloride is dosed and mixed into the active once the homogeneous dispersion has been formed, that is the salt is added after the active has been mixed with water. We have found that particularly stable compositions are formed in this way.

By use of this process fabric conditioning compositions can be manufactured at a rate of up to 200 gallons per minute, more typically 50 to 150 gallons per minute.

It is essential that when the molten fabric conditioning active and water are mixed, a homogeneous dispersion of the active is formed. Due to the viscosity resulting from water/active contacting, mixing with a dynamic mixer capable of developing a high shear rate enables the formation of a homogeneous dispersion of active particles. Homogeneity and control of the particle size distribution achieved in this manner is not possible in a batch mixer since insufficient shear is available to break up the viscous gel. Similarly, insufficient shear during salt addition results in a poor and delayed distribution of salt into the mix and attendant instability.

Preferably the molten fabric conditioning active and water are mixed in first one and then another in-line dynamic mixer before any salt addition takes place.

We have found that multistage addition of electrolyte is critical to producing stable fabric conditioning compositions. Preferably the electrolyte is added in three stages, more preferably five stages. More preferably the electrolyte additions are not all equal with at least one portion being smaller than a subsequent portion. Preferably there is a 2 to 60 second residence time in the pipeline between each mixing stage, more preferably 4 to 20 seconds and most preferably 4 to 15 seconds.

The following non-limiting examples illustrate the present invention.

EXAMPLE 1

The following example shows the importance of controlled shear in the mixing of the cationic fabric conditioning agent and water.

A composition comprising 16% ACCOSOFT 540 (a diamino ammonium methyl sulfate ex. Stepan), 6.5% Adogen 442 (a tallow dimethyl ammonium chloride ex. Sherex), 0.18% $CaCl_2$, 1.0% perfume, 0.1% glutaraldehyde and 0.005% Acid Blue 80 was made by pumping, with a Bran and Lubbe piston positive displacement pump, the molten actives at 160° F. and water at 160° F. containing the glutaraldehyde and dye into the pipeline of a continuous mixer immediately upstream of an in-line dynamic mixer of type 2 inch Gifford-Wood and mixing at varying speeds. The resulting dispersion was pumped along the pipeline of the continuous mixer for 4 seconds and mixed with 0.02% $CaCl_2$ from a 10% solution in a further shear mixer of type Dicon at a motor speed of up to 3600 rpm. The resulting composition was pumped along the pipeline of the continuous mixer for 4 seconds and mixed with 0.04% $CaCl_2$ in a further shear mixer, a Charlotte colloid mill. The resulting composition was pumped along the pipeline of the continuous mixer for 4 seconds and mixed with 0.08% $CaCl_2$ in a further shear mixer. The resulting composition was fed to a relay tank where it was cooled to 80° F. and a further addition of 0.04% $CaCl_2$ and 1.0% perfume was made with mixing by an A310 Lightnin agitator.

The resulting compositions had the following properties:

| | SAMPLE | | | |
|---|---|---|---|---|
| | A | B | C | D |
| Active/Water Dynamic Mixer Peripheral Velocity ft/s | 0 | 15.75 | 34.12 | 52.5 |
| Initial Viscosity of Comp. Haake $110s^{-1}$ cP | 77 | 55 | 90 | 121 |
| Mean Particle Size of active in microns [D(v,0.5)] | 2.81 | 1.43 | 0.35 | 0.47 |
| Particle size of 10% of the distribution [D(v,0.1)] | 0.62 | 0.47 | 0.17 | 0.26 |
| % of particle size of 10% of the distribution to the mean particle size | 22 | 32.9 | — | — |
| 1 week at 105° F. Viscosity Brookfield No. 1 or 3 spindle | NT | 220 | 1112 | 1944 |
| 2 weeks at 105° F. Viscosity Brookfield No. 1 or 3 spindle | NT | 233 | 1144 | 2168 |
| 3 weeks at 105° F. Viscosity Brookfield No. 1 or 3 spindle | NT | 228 | 1144 | — |
| 4 weeks at 105° F. Viscosity Brookfield No. 1 or 3 spindle | NT | 243 | 1368 | — |

As can be seen from the results above, the dynamic mixer speed in the first stage of the process has a significant effect on the viscosity of the composition generated even after identical salt additions. Controlled shear mixing of the active and water is essential to the generation of an acceptable product.

EXAMPLE 2

This example shows the effect of the salt addition profile on the stability of the composition.

A composition comprising 16% ACCOSOFT 540, 6.5% Adogen 442, 0.18% $CaCl_2$, 0.1% glutaraldehyde and 0.005% Acid Blue 80 and 1.0% perfume was made as described in Example 1 except that active/water mix was mixed at 30% speed and $CaCl_2$ additions were made in the continuous mixer as detailed in the table below.

| | SAMPLE | | | |
|---|---|---|---|---|
| | A | B | C | D |
| Active/Water Dynamic Mixer Peripheral Velocity ft/s | 15.75 | 15.75 | 15.75 | 15.75 |
| First $CaCl_2$ addition % | 0.02 | 0.04 | 0.07 | 0.14 |
| Second $CaCl_2$ addition % | 0.04 | 0.10 | 0.07 | 0.00 |
| Third $CaCl_2$ addition % | 0.08 | 0.00 | 0.00 | 0.00 |
| Mean Particle Size | 1.68 | 1.30 | 1.38 | 1.35 |
| 10% distribution particle size | 0.6 | 0.3 | 0.33 | 0.38 |
| % of 10% to mean particle size | 35.7 | 23 | 23.9 | 28 |
| 1 week at 105° F. Viscosity Brookfield No. 1 or 3 spindle cP | 120 | 430 | 265 | 1048 |
| 2 weeks at 105° F. Viscosity Brookfield No. 1 or 3 spindle cP | 103 | 951 | 423 | 1040 |
| 3 weeks at 105° F. Viscosity Brookfield No. 1 or 3 spindle cP | 143 | 1176 | 952 | 1176 |

These results show that a three stage salt addition (sample A) during processing gives rise to a lower viscosity in the final composition.

EXAMPLE 3

This example shows the effect of the particle size distribution on the stability of the composition.

A composition comprising by weight 18% ACCOSOFT 540 HC, 6.5% Adogen 442E-83, 0.24% $CaCl_2$, 1.1% perfume, 0.1% glutaraldehyde, 0.005% Acid Blue 80 and balance water was made as described in example 1 except that (i) the active/water mix was mixed in a ROSS dynamic mixer at various speeds, (ii) the dye was added in the relay mixer and (iii) a total of five salt additions were made to the composition in the continuous mixer. These were made to the composition in the following discrete portions 0.01%, 0.02% and 0.03% as a 2.5% solution, 0.04% and 0.04% by weight as a 10% solution. The resulting composition was finished to 0.24% $CaCl_2$ in a relay mixer where perfume and dye were also added. The particle size distribution and viscosity following various periods of storage up to 4 weeks at 105° F. were measured as detailed above.

| Composition | Mean Particle Size - Microns | 10% Distribution Particle Size | Total No. of weeks at 105° F. below 800 cps | % of 10% to mean |
|---|---|---|---|---|
| A | 2.26 | 0.47 | 0 | 20.8 |
| B | 1.14 | 0.32 | 0 | 28.1 |
| C | 1.22 | 0.29 | 1 | 23.8 |
| D | 1.17 | 0.30 | 1 | 25.6 |
| E | 0.93 | 0.27 | 1 | 29.0 |
| F | 1.23 | 0.28 | 1 | 22.8 |
| G | 1,23 | 0.31 | 2 | 25.2 |
| H | 1.22 | 0.28 | 2 | 23.0 |
| I | 2.44 | 0.58 | 2 | 23.8 |
| J | 1.18 | 0.32 | 2 | 27.1 |
| K | 2.08 | 0.47 | 2 | 22.6 |
| L | 1.57 | 0.45 | 2 | 28.7 |
| M | 1.04 | 0.35 | 3 | 33.7 |
| N | 0.93 | 0.32 | 3 | 39.3 |
| O | 3.96 | 1.32 | 3 | 34.4 |
| P | 1.59 | 0.60 | 3 | 37.7 |
| Q | 2.07 | 0.74 | 3 | 35.7 |
| R | 1.39 | 0.49 | 3 | 35.3 |
| S | 3.87 | 1.39 | 3 | 35.9 |
| T | 2.05 | 0.81 | 3 | 39.5 |
| U | 1.27 | 0.54 | 3 | 42.5 |
| V | 1.24 | 0.46 | 3 | 37.1 |
| W | 1.99 | 0.81 | 3 | 40.7 |
| X | 1.15 | 0.41 | 3 | 35.7 |
| Y | 1.10 | 0.40 | 3 | 36.4 |
| Z | 2.08 | 0.70 | 3 | 33.70 |
| AA | 1.88 | 0.79 | 3 | 42.0 |
| AB | 2.03 | 0.81 | 4 | 39.9 |
| AC | 2.04 | 0.74 | 4 | 36.3 |
| AD | 2.04 | 0.71 | 4 | 34.3 |
| AE | 2.03 | 0.70 | 4 | 35.0 |
| AF | 1.93 | 0.67 | 4 | 34.7 |
| AG | 2.12 | 0.69 | 4 | 32.5 |
| AH | 2.08 | 0.74 | 4 | 35.6 |
| AI | 3.05 | 1.15 | 4 | 37.7 |
| AJ | 2.10 | 0.77 | 4 | 36.7 |
| AK | 1.86 | 0.72 | 4 | 38.7 |
| AL | 2.89 | 0.93 | 4 | 32.2 |
| AM | 0.78 | 0.26 | 4 | 33.3 |
| AN | 0.77 | 0.26 | 4 | 33.8 |
| AO | 0.79 | 0.26 | 4 | 32.9 |
| AP | 0.78 | 0.26 | 4 | 33.3 |
| AQ | 0.84 | 0.27 | 4 | 32.1 |
| AR | 2.08 | 0.73 | 4 | 35.1 |
| AS | 1.59 | 0.61 | 4 | 38.4 |
| AT | 1.29 | 0.36 | 4 | 27.9 |
| AU | 0.79 | 0.25 | 4 | 32.5 |
| AV | 1.42 | 0.48 | 4 | 33.8 |
| AW | 2.57 | 0.8 | 4 | 31.1 |

-continued

| Composition | Mean Particle Size - Microns | 10% Distribution Particle Size | Total No. of weeks at 105° F. below 800 cps | % of 10% to mean |
|---|---|---|---|---|
| AX | 2.15 | 0.74 | 4 | 34.4 |

These results show that preferred stabilities are obtained from a 24.5% active mixture when the mean particle size is between 0.7 and 4 microns and the percentage of the particle size of 10% of the distribution to the mean particle size is at least 29%, preferably at least 32%.

EXAMPLE 4

This example shows the effect of controlled shear mixing the active/water mixture in two dynamic mixers before salt addition.

A composition comprising 18% ACCOSOFT 540 HC, 6.5% Adogen 442E-83, 1.1% perfume, 0.1% glutaraldehyde, 0.24% $CaCl_2$ and 0.005% Acid Blue 80 was made as described in Example 3 except that Ross Dynamic mixers were used in-line at all stages and a series of five salt additions were made in the continuous mixer. The salt additions were as described in Example 3.

| | A | B |
|---|---|---|
| 1st Active/Water Dynamic Mixer Motor Speed - rpm | 2500 | 10000 |
| 2nd Active/Water Dynamic Mixer Motor Speed - rpm | 10000 | 10000 |
| 1st salt addition motor velocity rpm | 7500 | 3000 |
| 2nd salt addition motor velocity rpm | 3000 | 3000 |
| 3rd salt addition motor velocity rpm | 3000 | 3000 |
| 4th salt addition motor velocity rpm | 3000 | 3000 |
| 5th salt addition motor velocity rpm | 3000 | 3000 |
| Mean Particle Size - microns | 2.1 | 0.47 |
| 10% distribution particle size - microns | 0.77 | 0.19 |
| % of 10% size to mean size | 36.8 | — |
| Viscosity after 1 week at 105° F. cP | 78 | 2225 |
| Viscosity after 4 weeks at 105° F. cP | 240 | — |

EXAMPLE 5

This example demonstrates the effect of residence time between each mixing stage of the electrolyte into the fabric conditioning mixture.

A dispersion comprising 16% Accosoft 540 HC (a diamino ammonium methyl sulfate ex. Stepan), 6.5% Adogen 442E-83, 0.24% $CaCl_2$, 0.8% perfume, 0.07% gluteraldehyde, 0.005% Acid Blue 80 was made as described in Example 1.

To more effectively control residence time the salt was added to the resulting dispersion outside of the pipeline of the continuous mixer. Six additions of salt were added to each of Dispersions A and B at 2 and 4 seconds residence time, respectively, in the following amounts: 0.01%; 0.02%; 0.03%; 0.04%; 0.04% and 0.1%.

The resulting dispersions were stored for at least six weeks at 105° F. Viscosity readings were obtained for each dispersion type weekly using a Brookfield No. 1 or 3 spindle as described in Example 1 with the following results:

| Sample | Initial | Viscosity 1 week | Viscosity 2 weeks | Viscosity 3 weeks | Viscosity 6 weeks |
|---|---|---|---|---|---|
| A-2 sec. residence time | 225 | 195 | 265 | 405 | 640 |
| B-4 sec. residence time | 155 | 125 | 150 | 240 | 480 |

It was thus observed that a 2 second residence time between salt additions, preferably 4 seconds, yielded stable products with desirable viscosities.

We claim:

1. A concentrated aqueous fabric conditioning composition comprising:

a homogeneous dispersion of from about 15% to about 80% by weight of cationic conditioning active particles, the cationic particles having a particle size distribution such that the mean particle size is from 0.7 to 10 microns and the particle size at which 10% of the distribution, in Malvern terminology, is calculated as at least 29% of the mean particle size, the concentrated aqueous fabric conditioning composition being stable and pourable and having a viscosity below about 1000 centipoises after 2 weeks storage at 105° F. measured by a Brookfield Viscometer on Spindle No. 1 at 12 rpm.

2. A concentrated aqueous fabric conditioning composition as claimed in claim 1 wherein the composition comprises from 0.01% to 0.5% by weight of an ionizable salt.

3. A concentrated aqueous fabric conditioning composition as claimed in claim 1 wherein the active particles have a size distribution such that the mean particle size is from 0.7 to 5 microns.

4. A concentrated aqueous fabric conditioning composition having a homogeneous dispersion of from about 15% to about 80% by weight of fabric conditioning active particles, the active particles having a particle size distribution such that the mean particle size is from 0.7 to 10 microns and the particle size at which 10% of the distribution, in Malvern terminology, is calculated as at least 29% of the mean particle size, the composition obtained by adding the fabric conditioning active to a continuous mixture, dispersing the fabric conditioning active in water under controlled shear in a continuous mixture to form a homogeneous dispersion of the active, and mixing the homogeneous dispersion with discreet portions of ionizable salt under controlled shear in the continuous mixture to maintain the homogeneous dispersion, the resulting concentrated aqueous fabric conditioning composition being stable and pourable and having a viscosity below about 1000 centipoises after 2 weeks storage at 105° F. measured by a Brookfield Viscometer on Spindle No. 1 at 12 rpm.

5. A concentrated composition according to claim 4 wherein the composition is obtained by sequentially adding the ionizable salt to the homogeneous dispersion with about 2 or more seconds between the addition of each discreet portion.

6. A concentrated composition according to claim 5 wherein the composition is obtained by sequentially adding each discreet portion of ionizable salt to the homogeneous dispersion such that at least one discreet portion is smaller than a subsequent portion.

* * * * *